US005547001A

United States Patent [19]

Cumming et al.

[11] Patent Number: 5,547,001

[45] Date of Patent: Aug. 20, 1996

[54] KINDLING WOOD SPLITTER DEVICE

[76] Inventors: Ronald F. Cumming; Donald A. Fraser, both of Box 92, Tumbler Ridge, B.C., Canada, V0C 2W0

[21] Appl. No.: 489,354

[22] Filed: Jun. 12, 1995

[51] Int. Cl.[6] ..... B27L 7/00

[52] U.S. Cl. ..... 144/195.4; 125/23.01; 144/366; 144/195.5; 25.41/130

[58] Field of Search ..... 254/130; 125/23.01, 125/36; 144/193 R, 193 C, 193 H, 366

[56] References Cited

U.S. PATENT DOCUMENTS

| | | | |
|---|---|---|---|
| 168,649 | 10/1875 | Lafus | 144/193 C |
| 720,010 | 2/1903 | Eiden | 144/193 C |
| 881,538 | 3/1908 | Bienk | 144/193 C |
| 2,526,362 | 10/1950 | Johnston | 144/193 R |
| 4,244,407 | 1/1981 | McMullin | 144/193 R |
| 4,354,537 | 10/1982 | Balkus | 144/193 H |
| 5,355,919 | 10/1994 | Knox | 144/193 R |

FOREIGN PATENT DOCUMENTS

| | | | |
|---|---|---|---|
| 17768 | 7/1909 | United Kingdom | 144/193 H |

*Primary Examiner*—W. Donald Bray

[57] ABSTRACT

A kindling wood splitter device comprising: a beam formed in an elongated configuration and positioned vertically in an operative orientation; an upper bracket including a front surface with frontwardly projecting members and a rear surface affixed to an upper extent of the beam, a handle formed in an elongated configuration being rotatably coupled between the frontwardly projecting members; a sliding cutter assembly comprising a slidable wedge holder and a wedge, the holder being slidably coupled to the beam and including frontwardly projecting bars, the wedge including a blade with a point oriented in a downward direction, the wedge having an upper end coupled between the bars of the holder; and a linkage shaft formed in a planar configuration with an upper claw and a lower claw, the lower claw being rotatably coupled to the sliding cutter assembly, the upper claw being rotatably coupled to the handle.

3 Claims, 3 Drawing Sheets

KINDLING WOOD SPLITTER DEVICE

BACKGROUND OF THE INVENTION

1. Field of the Invention

The present invention relates to a kindling wood splitter device and more particularly pertains to splitting presplit mill ends or short boards for the purpose of creating effective starting wood.

2. Description of the Prior Art

The use of wood splitting devices is known in the prior art. More specifically, wood splitting devices heretofore devised and utilized for the purpose of splitting wood into a plurality of pieces by various users are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,268,273 to Schneider a kindle maker.

U.S. Pat. No. 4,294,298 to Otte, Jr., discloses a impact cutting tool.

U.S. Pat. No. 4,033,390 to Piontkowski discloses a wood splitter.

U.S. Pat. No. 4,378,037 to Conn discloses a three-way log splitter assembly.

U.S. Pat. No. 4,431,040 to Friedrich discloses a manual impact-type log splitter and method for making same.

Lastly, U.S. Pat. No. 4,491,164 to Waikas discloses a impact driven wood splitter.

In this respect, the kindling wood splitter device according to the present invention substantially departs from the conventional concepts and designs of the prior art, and in doing so provides an apparatus primarily developed for the purpose of splitting presplit mill ends or short boards for the purpose of creating effective starting wood.

Therefore, it can be appreciated that there exists a continuing need for a new and improved kindling wood splitter device which can be used for splitting presplit mill ends or short boards for the purpose of creating effective starting wood. In this regard, the present invention substantially fulfills this need.

SUMMARY OF THE INVENTION

In view of the foregoing disadvantages inherent in the known types of wood splitting devices now present in the prior art, the present invention provides an improved kindling wood splitter device. As such, the general purpose of the present invention, which will be described subsequently in greater detail, is to provide a new and improved kindling wood splitter device and method which has all the advantages of the prior art and none of the disadvantages.

To attain this, the present invention essentially comprises a new and improved kindling wood splitter device comprising, in combination: an I-beam formed in an elongated configuration with a front plate, a back plate and a central plate affixed perpendicularly therebetween, the I-beam being positioned vertically in an operative orientation, the front plate having an upper region and a lower region, each region including mounting holes; an upper bracket including a front surface with two frontwardly projecting members and a rear surface including a recessed slot, the bracket including mounting holes to permit secure coupling to the upper region of the front plate of the I-beam with cooperatively coupled bolts, an axle being positioned in a horizontal orientation between the frontwardly projecting members; a handle formed in an elongated planar configuration having an elongated central aperture with an inboard extent and an outboard extent, the aperture having an upper edge and a lower edge, the upper edge including a plurality of semicircular grooves, the handle including a rounded outboard end and an inboard end having a circular aperture, the aperture of the inboard end being rotatably coupled to the axle of the upper bracket; a platform formed in a planar generally rectangular configuration, the platform being positioned horizontally and including a vertical brace member having mounting holes, the brace member being coupled to the lower region of the front face of the I-beam with cooperatively coupled bolts, the platform permitting the secure positioning of kindling wood to be split; a sliding cutter assembly comprising a slidable wedge holder and a wedge, the wedge holder including a front surface with two frontwardly projecting bars and a rear surface including a recessed slot, the recessed slot permitting slidable coupling to the front plate of the I-beam, the bars including a plurality of apertures, the wedge including a generally triangular shaped blade with a point oriented in a downward direction, the wedge having an upper end including apertures, the upper end adapted to be coupled between the bars with cooperatively coupled bolts; and a linkage shaft formed in a planar rectangular configuration with an upper claw and a lower claw, the lower claw being rotatably coupled to the sliding cutter assembly, the upper claw including a large cylindrical pin member with a resilient coil spring, the pin member being positionable within one of the semicircular grooves of the handle, a user positioning the pin in the inboard extent of the aperture and pulling the handle downwardly to split large pieces of kindling wood, a user positioning the pin in the outboard extent of the aperture and pulling the handle downwardly to split small pieces of kindling wood.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved kindling wood splitter device which has all of the advantages of the prior art wood splitting devices and none of the disadvantages.

It is another object of the present invention to provide a new and improved kindling wood splitter device which may be easily and efficiently manufactured and marketed.

It is further object of the present invention to provide a new and improved kindling wood splitter device which is of durable and reliable constructions.

An even further object of the present invention is to provide a new and improved kindling wood splitter device which is susceptible of a low cost of manufacture with regard to both materials and labor, and which accordingly is then susceptible of low prices of sale to the consuming public, thereby making such kindling wood splitter device economically available to the buying public.

Still yet another object of the present invention is to provide a new and improved kindling wood splitter device which provides in the apparatuses and methods of the prior art some of the advantages thereof, while simultaneously overcoming some of the disadvantages normally associated therewith.

Still another object of the present invention is to split presplit mill ends or short boards for the purpose of creating effective starting wood.

Lastly, it is an object of the present invention to provide a new and improved kindling wood splitter device comprising: a beam formed in an elongated configuration and positioned vertically in an operative orientation; an upper bracket including a front surface with frontwardly projecting members and a rear surface affixed to an upper extent of the beam, a handle formed in an elongated configuration being rotatably coupled between the frontwardly projecting members; a sliding cutter assembly comprising a slidable wedge holder and a wedge, the holder being slidably coupled to the beam and including frontwardly projecting bars, the wedge including a blade with a point oriented in a downward direction, the wedge having an upper end coupled between the bars of the holder; and a linkage shaft formed in a planar configuration with an upper claw and a lower claw, the lower claw being rotatably coupled to the sliding cutter assembly, the upper claw being rotatably coupled to the handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
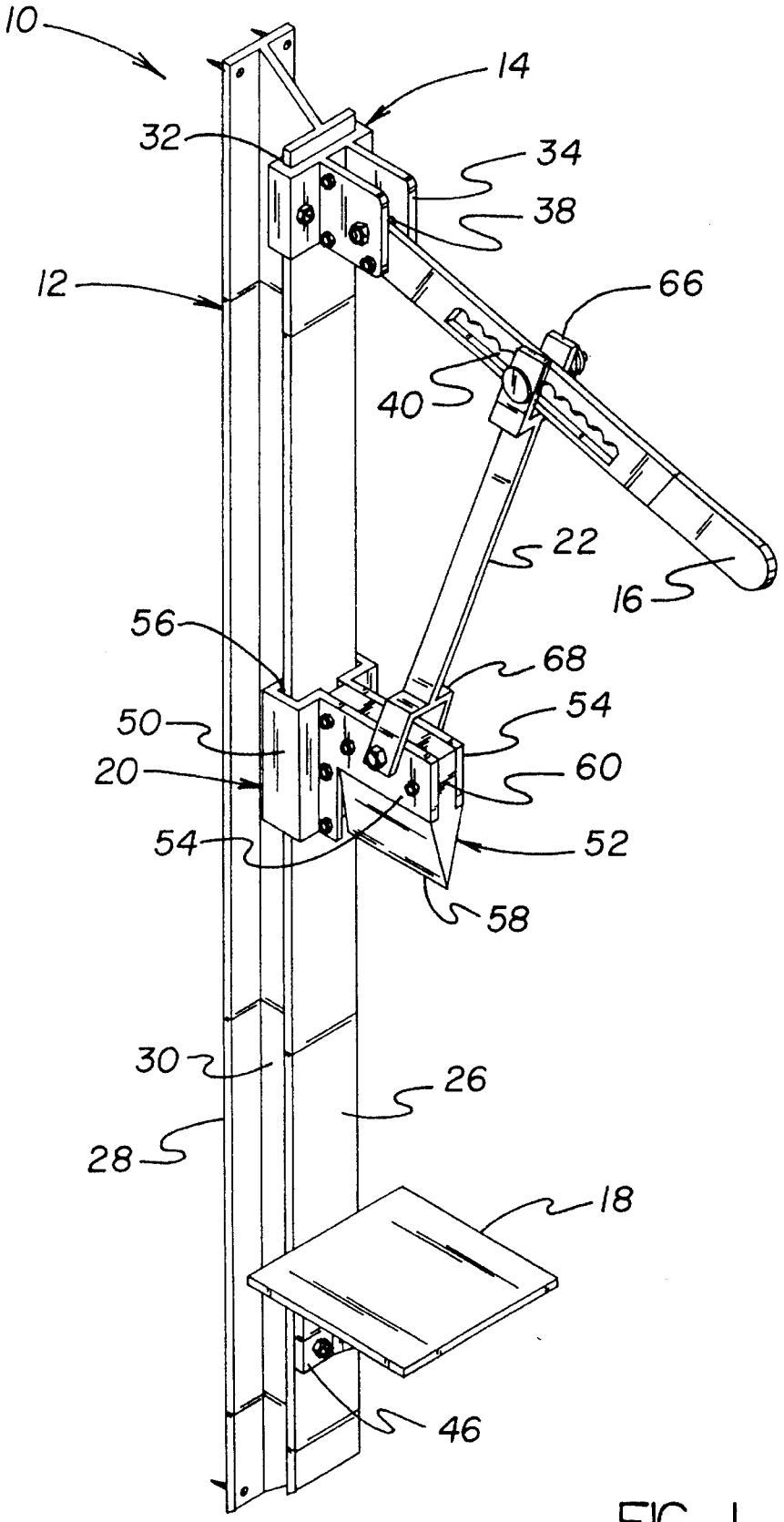
FIG. 1 is a perspective view of the preferred embodiment of the kindling wood splitter device constructed in accordance with the principles of the present invention.

With reference now to the drawings, and in particular to FIG. 1 thereof, the preferred embodiment of the new and improved kindling wood splitter device embodying the principles and concepts of the present invention and generally designated by the reference numeral 10 will be described.

The present invention, the kindling wood splitter device 10 is comprised of a plurality of components. Such components in their broadest context include an I-beam 12, an upper bracket 14, a handle 16, a platform 18, a sliding cutter assembly 20 and a linkage shaft 22. Such components are individually configured and correlated with respect to each other so as to attain the desired objective.

The kindling wood splitter device 10 is an apparatus utilized for splitting pre-split mill ends or short boards for the purpose of creating effective starting wood. To operate the apparatus kindling wood is placed upon the platform 18 located near the lower extent of the I-beam 12. The user then grasps the handle 16 and pulls it downward. This action forces the sharp blade of the wedge into the wood, splitting it in two pieces.

The apparatus 10 is a kindling splitter and not a wood chopper or log splitter. It is meant to be installed near a wood stove or a wood stockpile. It enables a user to further reduce pre-split or mill ends (short boards) to a thickness adequate to simplify lighting larger pieces of wood for a wood fire. The variable stroke adjustment of the handle will accommodate a variety of different wood lengths and densities.

Figure 2:
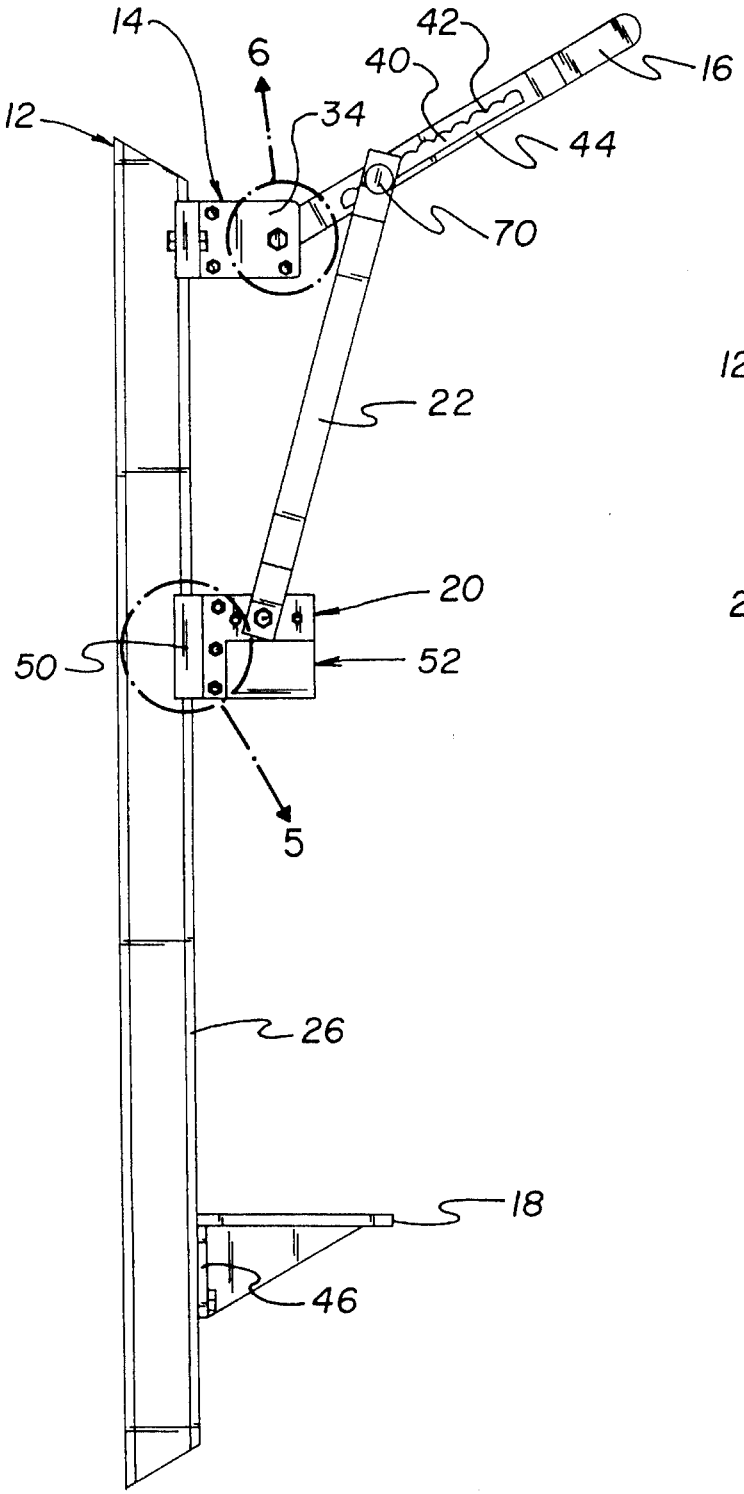
FIG. 2 is a side perspective view of the apparatus shown in FIG. 1 illustrating the handle positioned in a raised orientation.

More specifically, the I-beam 12 is fabricated of steel and formed in an elongated configuration with a front plate 26, a back plate 28 and a central plate 30 affixed perpendicularly therebetween. All of the other components of the apparatus are also fabricated of steel. The I-beam is positioned vertically in an operative orientation and measures two to three inches in width and forty to forty two inches in height. The sturdy beam is adapted to withstand the forces applied during use. The back plate of the beam is affixed to a wall or some other mounting surface in the preferred embodiment. In alternative embodiments the lowermost extent of the beam is affixed within the ground or cement. The front plate has an upper region and a lower region. Each region includes mounting holes. The mounting holes permit positioning of the bolts therethrough. Note FIGS. 1 and 2.

Figure 6:
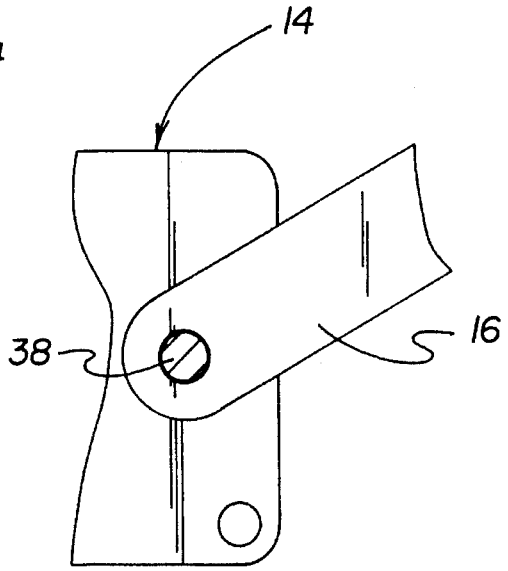
FIG. 6 is a cross sectional view taken along section line 6 of FIG. 2.

An upper bracket 14 includes a front surface with two frontwardly projecting members 34 and a rear surface with a recessed slot 32. The bracket includes mounting holes to permit secure coupling to the upper region of the front plate of the I-beam with cooperatively coupled bolts. An axle 38 is positioned in a horizontal orientation between the frontwardly projecting members. The axle is centrally positioned and permits rotatable coupling of the handle thereto. Note FIGS. 2 and 6.

Figure 3:
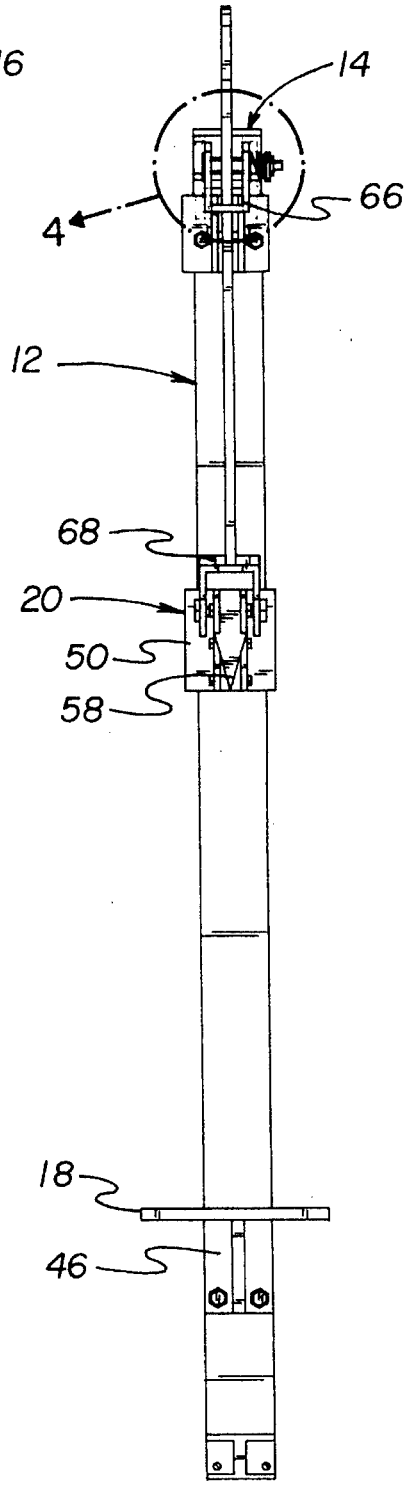
FIG. 3 is a front perspective view of the apparatus shown in FIG. 2.

A handle 16 is formed in an elongated planar configuration and has an elongated central aperture 40 with an inboard extent and an outboard extent. The central aperture has an upper edge 42 and a lower edge 44. The upper edge includes a plurality of semicircular grooves. The handle includes a rounded outboard end and an inboard end with a circular aperture. The rounded end provides a smooth surface for the user when grasping the handle. The aperture of the inboard end is rotatably coupled to the axle of the upper bracket. In an inoperative orientation the handle is positioned in an upwardly angled orientation. During use, the user grasps the handle and pulls it downward. In one embodiment the handle includes resilient means to return the handle to its upwardly angled orientation after release by the user. Note FIGS. 3 and 6.

A platform 18 is formed in a planar generally rectangular configuration. The platform is positioned horizontally and includes a vertical brace member 46 with mounting holes. The brace member is coupled to the lower region of the front face of the I-beam with cooperatively coupled bolts. The bolts utilized throughout the apparatus are between one quarter and one half inch in diameter. The platform permits the secure positioning of kindling wood to be split upon its upper surface. The kindling wood is positioned in a vertical orientation upon the platform. In an alternative embodiment of the apparatus the platform includes an wood holder formed in the shape of an inverted "J." This device acts to hold the wood in place while cutting. In a further alternative embodiment a small ridge is incorporated around the edge of the table top to assist in keeping wood in place. Note FIGS. 1 and 3.

A sliding cutter assembly 20 comprises a slidable wedge holder 50 and a wedge 52. The wedge holder includes a front surface with two frontwardly projecting bars 54 and a rear surface including a recessed slot 56. The recessed slot permits slidable coupling to the front plate of the I-beam. The wedge holder is coupled to the front plate by sliding the rear portion of the holder over the top of the front plate. In this orientation the holder and wedge can easily slide up and down the beam. The bars include three apertures. Note FIGS. 2 and 3.

The wedge includes a generally triangular shaped blade 58 with a point oriented in a downward direction. The blade measures between one eighth and three sixteenths of an inch in thickness. The wedge has an upper end 60 which includes three apertures. The upper end is adapted to be coupled between the bars with cooperatively coupled bolts. In one embodiment the sliding cutter assembly utilizes nylon wear studs and a spacer. The bolts are positioned through the two outside apertures. Note FIGS. 1 and 3.

Figure 4:
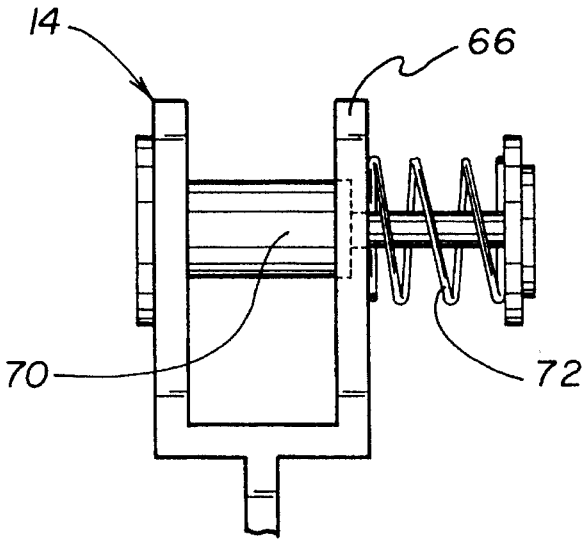
FIG. 4 is a cross sectional view taken along section line 4 of FIG. 3.
Figure 5:
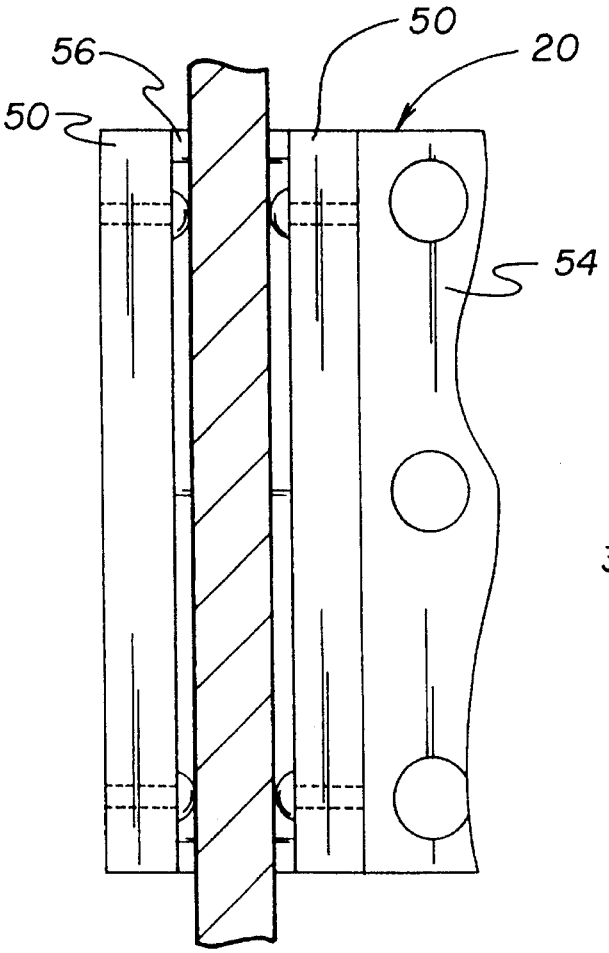
FIG. 5 is a cross sectional view taken along section line 5 of FIG. 2.

A linkage shaft 22 is formed in a planar rectangular configuration with an upper claw 66 and a lower claw 68. The lower claw is rotatably coupled to the central aperture in the sliding cutter assembly. The upper claw includes a large cylindrical pin member 70 with a resilient coil spring 72. The pin member is positionable within one of the semicircular grooves of the handle. The pin includes an extension rod positioned through the spring. When positioning the pin in a particular semicircular groove the user simply pulls the head of the pin and slides it to the desired groove. Upon release the coil spring 72 causes the pin 70 to become firmly secured in the desired groove. Note FIGS. 2 and 4.

A user positions the pin in the inboard extent of the aperture and pulls the handle to effect the minimum downward extension of the wedge. This orientation is utilized to split large pieces of kindling wood. A user positions the pin in the outboard extent of the aperture and pulls the handle to effect the maximum downward extension of the wedge. This orientation is utilized to split small pieces of kindling wood. Note FIGS. 3 and 4.

In order to realize the benefits of the kindling wood splitter device it is important to understand the purpose behind its creation. The apparatus was designed to provide fast, effective splitting of kindling wood without the use of a dangerous hatchet or axe. Some the other benefits of the apparatus are as follows:

The apparatus is great for physically impaired or elderly persons who are unable to wield an axe or hatchet. The apparatus splits wood fast and efficiently. It adjusts to mill ends/short boards of various lengths and densities. The platform can include an optional "J"-hook to hold wood in place. It creates kindling, which is necessary before larger logs can be added to the fire. It mounts easily near a wood pile or wood stove. Smaller kindling means fewer hassles while lighting the fire. It is excellent for those intimidated by the danger of working with a hatchet or axe, and eliminates the fear of many kinds of injuries. It helps get a blazing fire going in no time!

The kindling wood splitter device is designed to create effective kindling wood quickly and easily, yet without the danger associated with using a hatchet or axe. Utilizing the device, homeowners who love their fireplaces simply place the mill end or short board on the platform, pull down on the handle, and let the cutting head do the rest! The apparatus enables woodcutters to spend less time at work, and more time relaxing in front of a cozy, roaring fire.

Safety is a major point of the invention, particularly to elderly and handicapped individuals. With this invention handicapped persons will be able to split kindling without the use of a small axe and without worrying about cutting their fingers or being injured by flying debris. For safety reasons this is a very useful tool for any cottage or children's camp.

This item will especially benefit elderly and physically challenged people, and also anyone who is not comfortable wielding (handling) a sharp hatchet or axe. Control, speed and placement of the cutter head is insured, thereby greatly increasing the safety factor for everyone who enjoys the benefits of a wood fire. The fear of cut or lost fingers will be eliminated, thus enabling more people to safely ignite controlled fires.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved kindling wood splitter device comprising, in combination:

an I-beam formed in an elongated configuration with a front plate, a back plate and a central plate affixed perpendicularly therebetween, the I-beam being positioned vertically in an operative orientation, the front plate having an upper region and a lower region, each region including mounting holes;

an upper bracket including a front surface with two frontwardly projecting members and a rear surface including a recessed slot, the bracket including mounting holes to permit secure coupling to the upper region of the front plate of the I-beam with cooperatively coupled bolts, an axle being positioned in a horizontal orientation between the frontwardly projecting members;

a handle formed in an elongated planar configuration having an elongated central aperture with an inboard extent and an outboard extent, the aperture having an upper edge and a lower edge, the upper edge including a plurality of semicircular grooves, the handle including a rounded outboard end and an inboard end having a circular aperture, the aperture of the inboard end being rotatably coupled to the axle of the upper bracket;

a platform formed in a planar generally rectangular configuration, the platform being positioned horizontally and including a vertical brace member having mounting holes, the brace member being coupled to the lower region of the front face of the I-beam with cooperatively coupled bolts, the platform permitting the secure positioning of kindling wood to be split;

a sliding cutter assembly comprising a slidable wedge holder and a wedge, the wedge holder including a front surface with two frontwardly projecting bars and a rear surface including a recessed slot, the recessed slot permitting slidable coupling to the front plate of the I-beam, the bars including a plurality of apertures, the wedge including a generally triangular shaped blade with a point oriented in a downward direction, the wedge having an upper end including apertures, the upper end adapted to be coupled between the bars with cooperatively coupled bolts; and a linkage shaft formed in a planar rectangular configuration with an upper claw and a lower claw, the lower claw being rotatably coupled to the sliding cutter assembly, the upper claw including a large cylindrical pin member with a resilient coil spring, the pin member being positionable within one of the semicircular grooves of the handle, a user positioning the pin in the inboard extent of the aperture and pulling the handle downwardly to split large pieces of kindling wood, a user positioning the pin in the outboard extent of the aperture and pulling the handle downwardly to split small pieces of kindling wood.

2. A kindling wood splitter device comprising:

a beam formed in an elongated configuration and positioned vertically in an operative orientation, the beam measuring between two and four inches in width and between thirty-six and forty-eight inches in height;

an upper bracket including a front surface with frontwardly projecting members and a rear surface affixed to an upper extent of the beam, a handle formed in an elongated configuration with a plurality of spaced coupling devices positioned along its length, the handle being rotatably coupled between the frontwardly projecting members;

a sliding cutter assembly comprising a slidable wedge holder and a wedge, the holder being slidably coupled to the beam and including frontwardly projecting bars, the wedge including a blade with a point oriented in a downward direction, the wedge having an upper end coupled between the bars of the holder;

a linkage shaft in a planar configuration with an upper claw and a lower claw, the lower claw being rotatably coupled to the sliding cutter assembly, the upper claw being rotatably couplable in a spaced coupling device of the handle thereby allowing height adjustment of the wedge and permitting splitting of differently sized logs; and a platform formed in a planar generally rectangular configuration, the platform being positioned horizontally and including a vertical brace member, the brace member being coupled to a lower extent of the beam, the platform permitting the secure positioning of wood to be split.

3. A kindling wood splitter device comprising:

a beam formed in an elongated configuration and positioned vertically in an operative orientation;

an upper bracket including a front surface with frontwardly projecting members and a rear surface affixed to an upper extent of the beam, a handle formed in an elongated configuration being rotatably coupled between the frontwardly projecting members, the handle including an aperture with an upper edge having a plurality of semicircular grooves;

a sliding cutter assembly comprising a slidable wedge holder and a wedge, the holder being slidably coupled to the beam and including frontwardly projecting bars, the wedge including a blade with a point oriented in a downward direction, the wedge having an upper end coupled between the bars of the holder; and a linkage shaft formed in a planar configuration with an upper claw and a lower claw, the lower claw being rotatably coupled to the sliding cutter assembly, the upper claw being rotatably coupled to the handle, the upper claw of the linkage shaft including a large cylindrical pin member with a resilient coil spring, the pin member being positionable within one of the semicircular grooves of the handle, a user positioning the pin in an inboard extent of the aperture and pulling the handle downwardly to split large pieces of kindling wood, a user positioning the pin in an outboard extent of the aperture and pulling the handle downwardly to split small pieces of kindling wood.

* * * * *